US006260739B1

(12) United States Patent
Hsiao

(10) Patent No.: US 6,260,739 B1
(45) Date of Patent: Jul. 17, 2001

(54) SELF-CONTAINED HOSE ASSEMBLY FOR A PRESSURIZED CANISTER

(76) Inventor: Chung J. Hsiao, 807 Indiana St., Neodesha, KS (US) 66757

( * ) Notice: Subject to any disclaimer, the term of this patent is extended or adjusted under 35 U.S.C. 154(b) by 0 days.

(21) Appl. No.: 09/256,003

(22) Filed: Feb. 23, 1999

(51) Int. Cl.[7] ..... B67D 3/00

(52) U.S. Cl. ..... 222/538; 222/529; 222/530; 137/355.28

(58) Field of Search ..... 222/529, 530, 222/538; 137/355.28

(56) References Cited

U.S. PATENT DOCUMENTS

| | | | | |
|---|---|---|---|---|
| 2,384,174 | * | 9/1945 | Jones | 222/530 |
| 2,481,719 | * | 9/1949 | Buck | 222/530 |
| 2,577,045 | * | 12/1951 | Stout | 222/530 |
| 2,770,399 | * | 11/1956 | Gross | 222/530 |
| 2,789,734 | * | 4/1957 | Biederman | 222/530 |
| 2,987,228 | * | 6/1961 | Matson | 222/530 |
| 3,055,556 | * | 9/1962 | Hester | 222/530 |
| 3,160,333 | * | 12/1964 | Budrow | 222/530 |
| 3,863,817 | * | 2/1975 | Speaker | 222/530 |
| 4,305,528 | * | 12/1981 | Craig | 222/182 |
| 4,684,032 | * | 8/1987 | Tsay | 215/389 |
| 5,130,020 | * | 7/1992 | Meckstroth | 210/264 |
| 5,305,784 | | 4/1994 | Carter . | |
| 5,346,081 | * | 9/1994 | Lin | 215/229 |
| 5,601,211 | * | 2/1997 | Foster | 222/143 |
| 5,611,466 | | 3/1997 | Hsiao . | |
| 5,765,601 | | 6/1998 | Wells et al. . | |
| 5,890,631 | * | 4/1999 | Spurlock et al. | 222/538 |

* cited by examiner

*Primary Examiner*—John Rivell
*Assistant Examiner*—Thomas L. McShane
(74) *Attorney, Agent, or Firm*—Stinson, Mag & Fizzell, P.C.

(57) ABSTRACT

The invention is directed to a self-contained hose and valve assembly for installation on a pressurized canister. In one embodiment of the invention, a flexible hose is wrapped around a valve and is removably attached to a base supporting the valve. The hose and valve are housed within a cover that is removably secured to the base to form a self-contained unit. In an additional embodiment of the invention, the self-contained hose and valve assembly does not contain a cover and the hose is instead attached to the valve or the base by an adhesive or a mechanical fastener, such as a shrink sleeve to form the self-contained unit. The self-contained hose and valve assembly of the present invention reduces difficulties relating to installation, packaging, and storage of hose and valve assemblies for use with pressurized containers, such as tire inflation systems, in that the hose is securely affixed within the assembly and therefore will not interfere with automated assembly, installation, or packaging devices and will not become entangled with items in the trunk of a car during storage by the user.

29 Claims, 2 Drawing Sheets

Fig.6.
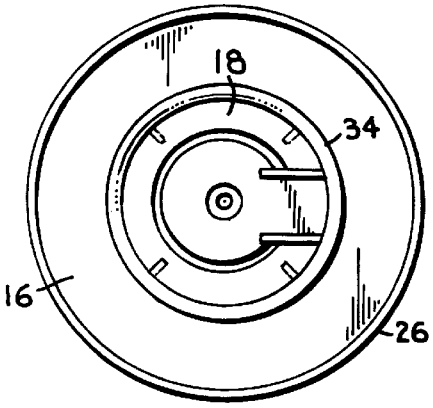
Fig.7.
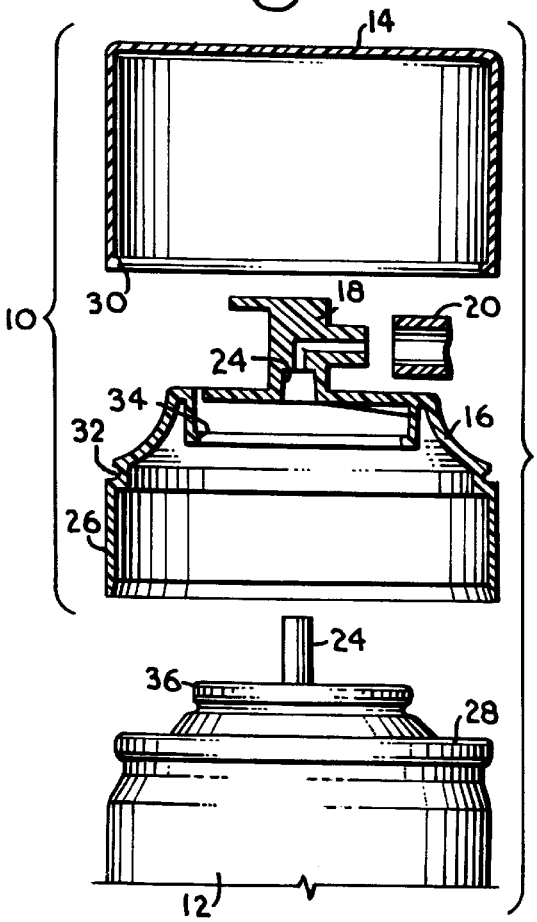
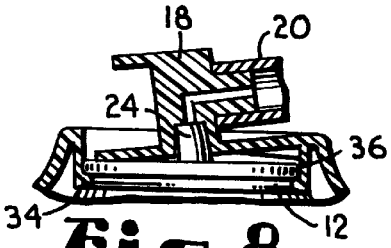
Fig.8.
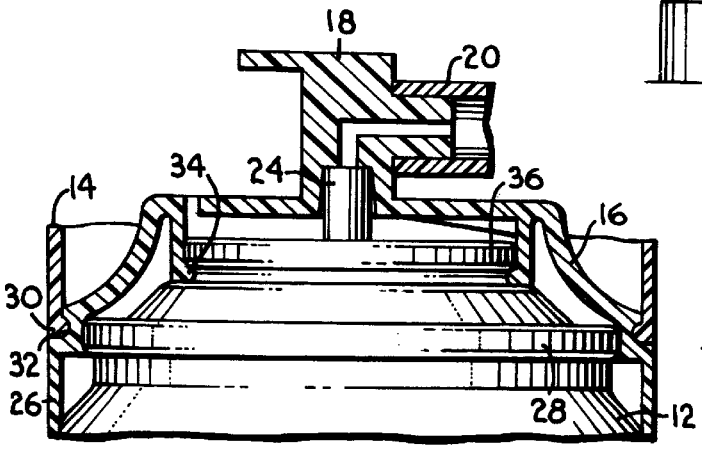
Fig.9.

SELF-CONTAINED HOSE ASSEMBLY FOR A PRESSURIZED CANISTER

BACKGROUND OF INVENTION

This invention generally relates to a hose assembly for use with canisters containing pressurized material such as tire inflation material, and the like, and a method of assembling the same. More specifically, the invention relates to a self-contained combined hose and valve assembly that can be installed on a pressurized canister by an automated means, such as by a capping machine.

Various pressurized canisters marketed today utilize hose and/or nozzle mechanisms for conveying and directing the material contained in the canister to the specific location at which the material is to be used. Typically these hose and/or nozzle mechanisms are received by the consumer as a separate piece attached to the outside of the canister, and in order to utilize the hose or nozzle, the user is required to attach the hose or nozzle onto a valve on the canister that communicates with the interior of the canister. Certain types of pressurized canisters, however, are unsuitable for hose attachment by the user due to the high pressures involved and the need for a secure attachment between the hose and valve that does not leak. For example, hoses for use with self-contained tire inflation systems comprising pressurized material in a canister are typically attached to the canister valve at the manufacturer to assure a secure connection between the hose assembly and the valve. Two such existing hose assemblies are described in U.S. Pat. No. 5,305,784 (the '784 patent), incorporated herein by reference and U.S. Pat. No. 5,611,466 (the '466 patent), issued to the inventor of the present invention, and also incorporated herein by reference.

As disclosed in the above-referenced patents, and as would be known to one skilled in the art, the connection between the hose and the canister valve used for self-contained tire inflation systems is particularly critical in that the pressures utilized for such tire inflation systems are relatively high; indeed, the pressure of such systems may be on the order of 150 to 170 pounds per square inch when the inflation system is left in a hot trunk of an automobile for storage. Further, such tire inflation systems contain materials which are potentially damaging if accidentally released, such as rubberized compounds for effectuating a temporary repair on a tire. For this reason, it is especially critical that the hose assemblies on pressurized canisters containing such materials be pre-assembled onto the valve at the factory, rather than by the user, and that the connection of the hose to the canister valve be of a durable design.

Pre-assembling hoses onto valves at the factory presents some problems, however, in that the assembly process typically must be performed by hand. Generally, the hose must be connected to the valve mechanism prior to placing the valve mechanism on the canister because the procedures for connecting the hose to the valve mechanism are best accomplished when these items are individual components not attached to the canister. To assure a secure connection, most hoses must be attached to the valve mechanism by hand. Conventional means of connecting the hose to the valve mechanism include slipping a flexible hose over a ribbed valve nozzle and then affixing the hose to the nozzle with pins, staples or the like such as is generally described in the '784 patent. The hose may also be affixed by other means such as by fitting a non-flexible sleeve over the end of the hose once the hose has been slipped onto a ribbed valve nozzle. The hose and valve assembly is then transported to a factory where it may be installed onto pre-filled canisters.

Installation of the hose and valve assembly onto the canister also typically must be performed by hand. Automated installation of the hose and valve assembly onto the pressurized canister is difficult because of the non-symmetric shape of the hose and valve assembly. Additional difficulties arise when a flexible hose is utilized, in that automated mechanisms cannot readily be modified to reliably place the flexible and/or unpredictably shaped hose and valve assembly onto a pressurized canister. In contrast, automated mechanisms, typically referred to as "capping machines," can readily accommodate the installation of valve assemblies that do not utilize such a hose assembly onto pressurized canisters.

Once the hose and valve assembly is installed on the pressurized canister, if the hose is flexible, it commonly is strapped to the side of the can with a rubber band or the like and thus readied for shipment. Generally, such process is performed by hand. The non-symmetric and/or flexible hose further causes difficulties in packaging the completed canister assemblies for shipment because it is difficult and costly to re-design automated machines to handle canisters with a rigid protruding hose or a flexible hose strapped to the side. Thus, much of the packaging of the canister must be performed as a manual process as well.

When purchased by the consumer, tire inflation canisters are commonly stored in a trunk of an automobile until the canister is needed. Even at this stage, flexible hoses attached to the outside of the canister can potentially cause problems because the hose can become entangled in other items in the trunk and become snagged, torn or the like and disabled from use.

Thus, there is a need for an improved mechanism for delivering pressurized components from a canister, such as for a tire repair and inflation system, which avoids the problems of manual assembly of the devices, manual packaging of the completed assemblies and storage difficulties presented by current tire inflation canisters and hose assemblies.

SHORT DESCRIPTION OF DRAWINGS

FIG. 6 shows a bottom view of one embodiment of the present invention taken along line 6—6 of FIG. 5.

FIG. 7 shows a side sectional view of one embodiment of the present invention, taken along line 7—7 of FIG. 3, with the hose and valve assembly, cover, and hose separated for clarity.

FIG. 8 shows a side sectional view of the valve of one embodiment of the present invention in which the valve is depressed.

FIG. 9 shows a side sectional view of the valve and base of the present invention in place on a canister.

SUMMARY OF INVENTION

Figure 1:
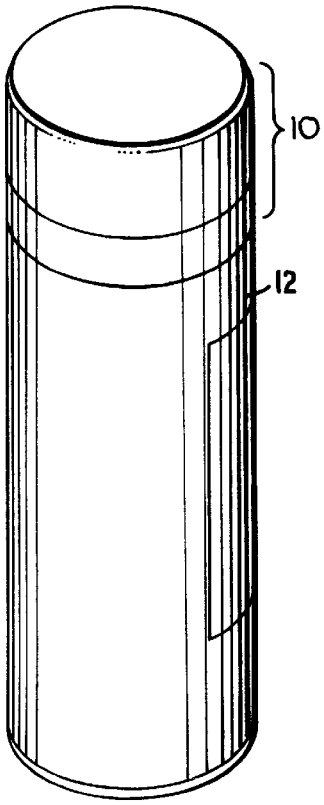
FIG. 1 shows a perspective view of a one embodiment of the hose and valve assembly of the present invention in place on top of a pressurized canister.

It is thus an object of the present invention to have a self-contained hose and valve assembly which is suitable for automated assembly onto a pressurized canister.

It is a further object of the present invention to have a self-contained hose and valve assembly which would facilitate automated packing and shipping of completed pressurized canisters.

It is a further object of the present invention to have pressurized canisters which present reduced hazards of the hose snagging, tearing or the like in storage prior to use of the devices.

The present invention is a hose and valve assembly in which the hose and valve assembly is a self-contained unit suitable for automated installation onto a pressurized canister. The hose and valve assembly is comprised of a valve having an inlet and outlet which are connected by a channel defined by the valve through which the pressurized material contained with canister can flow, and a flexible hose, one end of which is securely and operably attached to the outlet of the valve. Preferably, the hose and valve assembly further comprises a base that supports the valve. In the preferred embodiment, the hose encircles the valve and is positioned within the circumference of the base, such that the hose does not extend beyond the edge of the base. The hose may be constrained in place by a cover that houses the hose and valve and is secured onto the base. Alternatively, the hose may be removably held in place against the base or the exterior of the valve by any suitable adhesive or mechanical fastener, for example a flexible wire. The hose and valve, and optionally the base and cover, are thus assembled into a self-contained hose and valve assembly that can be readily handled by automated machinery.

The hose and valve assembly is assembled by first securely and operatively attaching one end of the flexible hose onto the valve outlet. If the valve is not already connected to the base, and a base is to be included in the hose and valve assembly, the valve is then connected to the base. The hose is folded, wound or otherwise wrapped around the valve and is held in place by removably affixing it to the base or the exterior of the valve. The hose is preferably affixed to the base by placing a cover over the hose and valve and securing the cover onto the base. In alternative embodiments the hose is affixed to the base or valve exterior by applying an adhesive or using a mechanical fastener.

The hose and valve assembly so assembled is self-contained such that the hose does not hang over the edge of the base in a manner that will interfere with automated machinery. Therefore, the completed hose and valve assembly may be automatically installed onto a pressurized canister and the canister and hose and valve assembly can be packaged for shipment by an automated means. Further, when a pressurized canister containing the hose and valve assembly of the present invention is stored in the trunk of a car, the hose is not free to become entangled with other objects within the trunk.

DESCRIPTION OF INVENTION AND PREFERRED EMBODIMENT

Referring first to FIG. 1, the present invention device is a self-contained hose and valve assembly, generally designated by the numeral 10, for use with a canister 12 containing pressurized materials, such as tire inflation material. FIG. 1 depicts one embodiment of hose and valve assembly 10 as it would appear assembled and installed on a canister 12 and ready for purchase and storage by a consumer.

Figure 2:
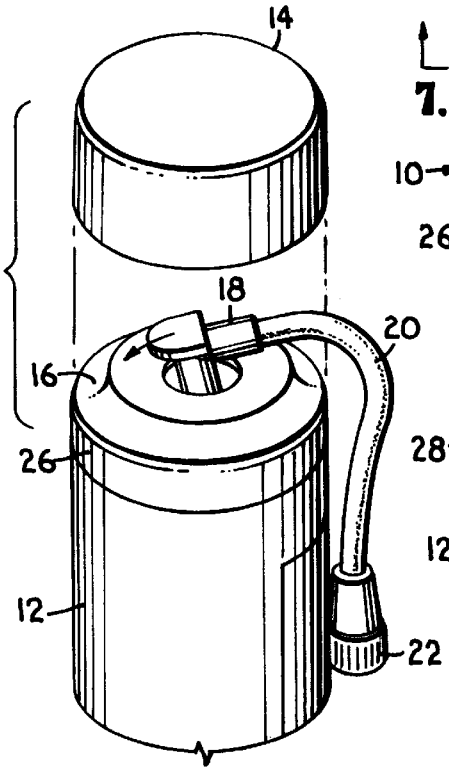
FIG. 2 shows a perspective view of the embodiment of FIG. 1 in which the cover is separated from the assembly.

FIG. 2 depicts a cover 14 separated from a base 16 of hose and valve assembly 10 to expose valve 18 and attached hose 20, all of which are part of the hose and valve assembly 10. As used herein, valve 18 refers to an external valve mechanism having an inlet and outlet connected by a channel defined by the valve through which the pressurized material contained in the canister can flow when valve 18 is depressed. In use, a consumer removes cover 14, as shown in FIG. 2, thereby freeing hose 20 for use. The consumer then directs hose nozzle 22 at the desired point of application and depresses valve 18 as indicated by the arrow in the figure to release the contents of canister 12 out of the outlet of valve 18, through hose 20 and out nozzle 22. As would be known to one skilled in the art, the precise configuration of nozzle 22 depends upon the planned usage of the hose and valve assembly. For example, when used as part of a tire inflation system, the interior of nozzle 22 threaded to mate with threads on the exterior of a tire valve.

Figure 3:
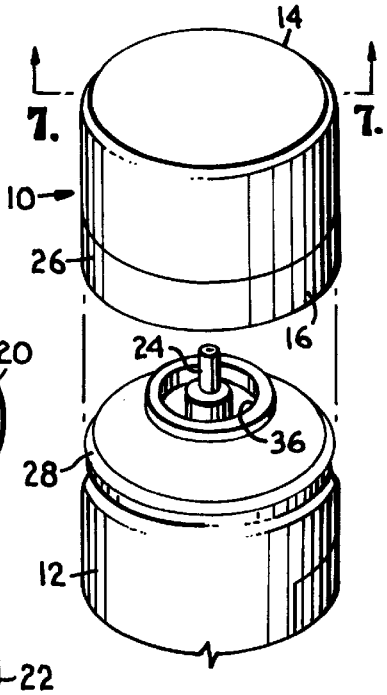
FIG. 3 shows a perspective view of the embodiment of FIG. 1 in which the hose and valve assembly is separated from the canister.

FIG. 3 shows the same embodiment of the invention wherein the complete hose and valve assembly 10 is separated from canister 12 to reveal releasing tube 24 of the canister. In this embodiment, base 16 is formed with skirt 26 that extends over lower rim 28 of canister 12 when the hose and valve assembly is installed on the canister. Skirt 26 helps to stabilize the hose and valve assembly 10 against canister 12.

Figure 4:
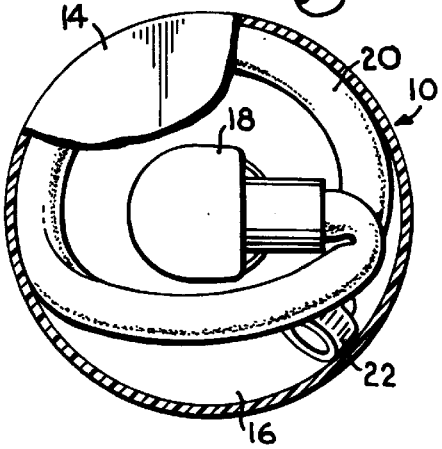
FIG. 4 shows a partial cutaway top view of the hose and valve assembly shown in FIG. 1.
Figure 5:
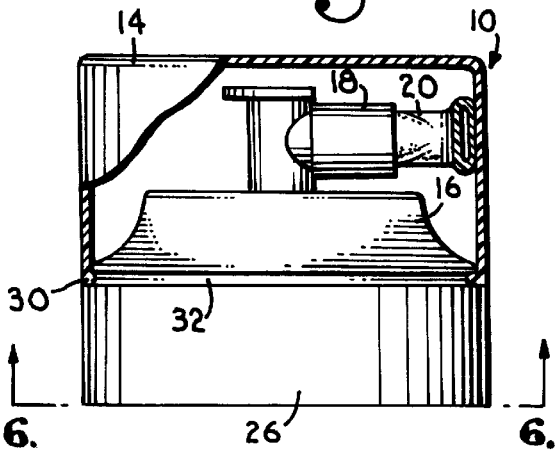
FIG. 5 shows a partial cutaway side view of the hose and valve assembly shown in FIG. 1.

As shown in FIGS. 4 and 5, hose and valve assembly 10 is preferably comprised of flexible hose 20, one end of which is securely and operably attached to the outlet of valve 18 through which the pressurized materials are dispensed. Hose 20 encircles valve 18 and rests on base 16, to which valve 18 is also connected and/or which supports valve 18. In this embodiment of the invention, hose 20 and valve 18 may be enclosed within cover 14, which is fitted snugly onto base 16, as shown in FIG. 5. Preferably, cover 14 contains cover ridge 30 around the interior surface of cover 14 proximate the bottom edge of cover 14. Base 16 defines a complementary channel 32 which engages cover ridge 30 when cover 14 is pressed downwardly onto base 16.

Returning to FIG. 4, prior to use, flexible hose 20 encircles valve 18 and is constrained such that hose 20 is substantially contained with in the circumference of base 16 and does not extend beyond the outer edges of base 16. As seen in FIG. 4, a kink, or sharp bend, in hose 10 may result from wrapping hose 10 around valve 18. To prevent kinking, a stress relief spring may be affixed around hose 10 to add strength and resistance to hose 10 at the point kinking would normally occur. In the device of the present invention, hose 20 remains in this configuration during assembly, packaging and storage. Hose 20 is unwound by the consumer and maneuvered to direct nozzle 22 toward the point of application before the consumer dispenses the contents of the canister by depressing valve 18.

Hose 20 can be constrained around valve 18 by various means that will removably affix hose 20 to base 16 or to the exterior of valve 18. In the embodiment shown in FIGS. 1–5, hose 20 is housed entirely within cover 14 which fits snugly onto base 16. In an alternative embodiment, not shown, hose 20 can be removably affixed directly to base 16, such as by an adhesive, mechanical fasteners, such as flexible wires or a shrink sleeve, or the like, as will be readily recognized by one skilled in the art of packaging. Essentially, in this alternative embodiment, the hose and valve assembly 10 will appear similar to the embodiment shown in FIG. 4 if cover 14 is removed. In a further embodiment, hose and valve assembly 10 does not contain base 16. In such embodiment, hose 20 is wrapped tightly around the exterior of valve 18 and affixed directly thereto by any suitable means known in the art.

Valve 18 can be of any configuration known in the art and will preferably be made from standard materials known in the art. Typically, valve 18 is made of rigid plastic and injection molded into a suitable shape. Valve 18 can be integrally formed with base 16 or can be a discrete and separate piece that is connected to and/or supported by base 16. In an alternative embodiment, hose and valve assembly 10 may not contain a base, and valve 18 may be configured to be installed directly onto canister 12. As shown in FIGS. 7, 8, and 9, when the hose and valve assembly is installed on canister 12, the inlet of valve 18 is positioned in contact with releasing tube 24 of the canister, such that when valve 18 is depressed, releasing tube 24 is actuated, allowing the interior channel of valve 18 to communicate with the interior of the canister and causing the material contained in the canister to be released from the canister, through releasing tube 24, into the valve channel, out of the valve outlet, through the hose and out the nozzle.

Many valve configurations known in the art, such as valve 18 shown in the figures, are of a flexible configuration and can be readily depressed, as shown by the arrow in FIG. 2 and reflected in FIG. 8. Such a flexible valve configuration cannot readily be handled by automated assembly machinery and any attempt to mechanically press fit an uncovered hose and valve assembly comprising such a valve onto a canister will cause the valve to actuate and release the material contained within the canister. Thus, when such flexible valve configurations are utilized, hose and valve assembly 10 will preferably also comprise cover 14, as shown in FIG. 5, which can be handled easily by automated machinery and will prevent the valve from actuating during assembly. As shown in FIG. 5, base 16, valve 18, hose 20 and cover 14 can all be assembled as a self-contained unit in which hose 20 is fully housed within cover 14.

In an alternative embodiment, the valve itself may be sufficiently rigid that it can be handled by automated machinery. For example, the valve mechanism disclosed in the '466 patent comprises a rigid wall portion surrounding the depressible nozzle portion. An automated machine, such as a capping machine, can readily accommodate such a rigid walled valve and can install the hose and valve assembly onto the canister by placing force on the rigid wall of the valve without causing the nozzle to actuate and dispense the contents of the canister. When such rigid walled valves are used in the present invention, cover 14 is not required. In embodiments in which cover 14 is not used, hose 20 may be removably affixed to base 16 of hose and valve assembly 10 by a variety of means, as discussed above. In such case, hose 20 is preferably folded or wound such that it does not extend beyond the circumference of base 16, so that hose 20 will not interfere with the automated assembly or packing machinery and will not snag on objects within a car trunk. If base 16 is not present, hose 20 is held in place simply by affixing it directly to the exterior of valve 18.

Base 16 and cover 14 are typically comprised of a rigid thermoplastic known in the packaging arts, such as polypropylene or polyester. Typically, base 16 and cover 14 will be formed by injection molding. Preferably, base 16 is configured as a circular piece having a downwardly extending skirt 26 along its circumference that can be fitted onto the canister to stabilize the hose and valve assembly against the canister, although any configuration that can support the valve and hose and can be installed onto the canister is consistent with the present invention. Skirt 26 can be configured to fit over and surround lower rim 28 of the canister, as best shown in FIGS. 3, 7 and 9, or can be configured to fit within the circumference of lower rim 28 to secure the base to the canister. FIGS. 7, 8 and 9 depict another means for holding base 16 snugly against canister 12, wherein base 16 is constructed with a circular lip 34 (also shown in FIG. 6) encircling the interior surface of base 16 proximate the upper edge of the base. Lip 34 engages an upper rim 36 of canister 12, thereby holding hose and valve assembly 10 snugly against the canister.

Cover 14 may be configured in any manner that will enclose hose 20 and valve 18, as will be readily understood by one skilled in the packaging arts. Preferably, cover 14 will contain cover ridge 30 to engage channel 32 in the base as shown in FIG. 5. Hose 20 is preferably made of a flexible material, such as clear or opaque plastic, for example polypropylene, or polyester, which can readily be folded, wound or wrapped around valve 18 during assembly and readily unwound and positioned by the user before dispensing the contents of the container.

The process of assembling the hose and valve assembly and installing the assembly onto the canister is preferably as follows: One end of hose 20 is securely and operably attached onto the outlet of valve 18 utilizing conventional methods such as press fitting, stapling, or fixing the flexible hose 20 within a rigid sleeve.

After attaching the end of hose 20 to the valve outlet, hose 20 is folded, wound or otherwise wrapped around valve 18, such that hose 20 is substantially contained within the circumference of base 16 and does not extend beyond the edges of base 16, as shown in FIG. 4. Hose 20 is then removably affixed to base 16 or the exterior of valve 18. In a first embodiment, cover 14 is placed over hose 20 thereby enclosing the entire hose 20 and valve 18 within cover 14. Cover 14 is secured onto base 16 by means of a skirt, lip or the like so that the entire hose and valve assembly 10 is a single self-contained unit.

In an alternative embodiment, the hose and valve assembly 10 does not contain a cover 14, and hose 20 may be removably affixed to base 16 or the exterior of valve 18 by an adhesive or a mechanical fastener, such as a flexible wire or wires, or a shrink sleeve, so long as valve 18 or base 16 is sufficiently rigid to be used in automated assembly machinery as discussed above.

In a second alternative embodiment of the invention, valve 18 is not integrally formed with base 16. In one such embodiment, one end of hose 20 is first securely and operably attached to the valve outlet by conventional means known in the art. The valve is then connected to the base by any suitable means known in the art. For example, the hose and valve may be inserted into a rigid base such that the hose extends through an aperture extending through the wall of the base. The valve is then positioned within the rigid base such that it can be depressed by the user, but such that a capping machine can press the rigid base onto the canister without depressing the valve.

In a third alternative embodiment, hose and valve assembly 10 does not contain a base 16. Hose 20 is wrapped around valve 18 as described above and affixed directly to the exterior surface of the valve by a suitable means discussed herein to form the self-contained hose and valve assembly 10.

The completed hose and valve assembly 10 may then be automatically installed onto a pressurized canister, such as a self-contained tire inflation system, by a capping machine or other automated assembly machine known in the art. As noted above, capping machines generally cannot accommodate a loose hose, and such a loose hose is not present in the hose and valve assembly of the present invention. In addition, the hose and valve assembly must possess a rigid upper surface onto which the machine can press to secure the hose and valve assembly onto the canister. In the present invention, a rigid upper surface is provided by the cover 14, base 16 or valve 18 as described above. For optimal efficiency, an automated capping machine generally requires an assembly having a regular exterior and a generally symmetric configuration. In the present invention, such exterior and configuration is provided by the cover 14 or by affixing the hose to the base or valve exterior. Preferably, the weight is distributed unevenly within the hose and valve assembly to allow the capping machine to correctly position the hose and valve assembly over the canister. Such uneven distribution results from the uneven distribution of the weight of the valve 18, hose 20 and nozzle 22 in the present invention. Thus, the present invention is well-suited to be handled by an automated capping machine.

The completed hose and valve assembly and canister may readily be packaged for shipment by automated means since the hose is contained within cover 14 or affixed directly to valve 18 or to base 16 within the circumference of the canister and, therefore, is not free to entangle automated machinery. Further, the assembled canister and hose and valve assembly may be conveniently stored within the trunk of an automobile insofar as the hose is not free to become entangled with other objects within the trunk.

The present invention includes the process for assembling the hose, valve, base and the cover into the completed hose and valve assembly and also installing that completed hose and valve assembly onto the pressurized canister. The present invention also includes the product of those processes.

Since many possible embodiments may be made of the invention without departing from the scope thereof, it is to be understood that all matters herein set forth or shown in the accompanying drawings are to be interpreted as illustrative and not in a limiting sense.

I claim:

1. A pre-assembled self-contained hose and valve unit for installation onto a pressurized canister, said unit comprising:

a valve having an inlet and an outlet;

a base supporting said valve; and a flexible hose wherein one end of said hose is operably attached to the outlet of said valve and wherein a length of said hose is constrained to encircle said valve;

wherein said valve, base and hose form a pre-assembled self-contained unit that is a separate entity from a pressurized canister; and wherein said unit is configured to allow installation of said unit onto the pressurized canister by an automated machine.

2. The hose and valve unit as claimed in claim 1, wherein said hose is constrained to encircle said valve by removably affixing said hose to said base.

3. The hose and valve unit as claimed in claim 2, wherein said hose is constrained to encircle said valve by a mechanical fastener.

4. The hose and valve unit as claimed in claim 3, wherein said mechanical fastener is a cover removably connected to said base, wherein said valve and said hose are housed within said cover.

5. The hose and valve unit as claimed in claim 3, wherein said mechanical fastener is a flexible wire.

6. The hose and valve unit as claimed in claim 2, wherein said hose is constrained to encircle said valve by an adhesive.

7. The hose and valve unit as claimed in claim 1, wherein said hose is constrained to encircle said valve by removably affixing said hose to the exterior of said valve.

8. The hose and valve unit as claimed in claim 7, wherein said hose is constrained to encircle said valve by a mechanical fastener.

9. The hose and valve unit as claimed in claim 7, wherein said hose is constrained to encircle said valve by an adhesive.

10. The hose and valve unit as claimed in claim 1, wherein said assembly has a rigid upper surface onto which an automated machine can press.

11. The hose and valve unit as claimed in claim 10, wherein said rigid upper surface is provided by a cover removably affixed to said base over said hose and said valve.

12. The hose and valve unit as claimed in claim 10, wherein said rigid upper surface is provided by the upper surface of said valve.

13. The hose and valve unit as claimed in claim 1, wherein said hose does not extend beyond the edges of said base.

14. A process for assembling a self-contained hose and valve unit for installation onto a pressurized container, comprising:

operably attaching one end of a flexible hose onto an outlet of a valve, wherein said valve is not attached to a pressurized container;

wrapping said hose around the exterior of said valve, wherein said valve is not attached to the pressurized container; and removably affixing said hose in place around said valve, wherein said valve is not attached to the pressurized container, to form a pre-assembled self-contained unit that is a separate entity from the pressurized container; and wherein said unit is configured to allow installation of said unit onto the pressurized container by an automated machine.

15. The product of the process as claimed in claim 14.

16. The method of assembling a hose and valve unit claimed in claim 14, wherein said removably affixing step comprises removably affixing said hose directly to the exterior surface of said valve, wherein said valve comprises a rigid copper surface.

17. The product of the process as claimed in claim 16.

18. The process of assembling a hose and valve unit as claimed in claim 14, wherein said removably affixing step comprises removably affixing said hose to a base supporting said valve, wherein said base is not connected to the pressurized container.

19. The product of the process as claimed in claim 18.

20. The process of assembling a hose and valve unit as claimed in claim 18, further comprising the steps of connecting said valve to said base prior to said removably affixing step.

21. The process of assembling a hose and valve unit as claimed in claim 18, wherein said valve is integrally formed with said base.

22. The process of assembling a hose and valve unit as claimed in claim 18, wherein said removably affixing step comprises placing a cover over said hose and said valve, and securing said cover onto said base.

23. The product of the process as claimed in claim 22.

24. A process for assembling a hose onto a pressurized container comprising:

operably attaching one end of a flexible hose onto the outlet of a valve, wherein said valve is not attached to said pressurized container;

wrapping said hose around the exterior of said valve;

removably affixing said hose in place around said valve to form a self-contained assembly; and operably installing said self-contained assembly onto said pressurized container.

25. The process for assembling a hose onto a pressurized container as claimed in claim 24, wherein said installing step comprises pressing down on a rigid upper surface of said self-contained assembly.

26. The process for assembling a self-contained assembly onto said pressurized container as claimed in claim 25, wherein said installing step is performed by an automated machine.

27. The process of assembling a hose onto a pressurized container as claimed in claim 25, wherein said installing step comprises installing said self-contained assembly onto a pressurized container containing a tire-inflation material.

28. The product of the process as claimed in claim 27.

29. A process for assembling a hose onto a pressurized container as claimed in claim 27, wherein said hose is wrapped around said valve such that said hose is does not extend beyond the edges of a base to which said valve is connected.

* * * * *

UNITED STATES PATENT AND TRADEMARK OFFICE

CERTIFICATE OF CORRECTION

PATENT NO. : 6,260,739 B1
DATED : July 17, 2001
INVENTOR(S) : Chung J. Hsiao

It is certified that error appears in the above-identified patent and that said Letters Patent is hereby corrected as shown below:

Column 8,
Line 8, delete "assembly" and insert -- unit -- therefore.

Signed and Sealed this

Second Day of April, 2002

*Attest:*

*Attesting Officer*

JAMES E. ROGAN
*Director of the United States Patent and Trademark Office*